United States Patent [19]

Spera

[11] 4,374,566

[45] Feb. 22, 1983

[54] JIB CRANE WITH POLYCENTRICAL TRAJECTORY

[76] Inventor: Claudio Spera, Salita Superiore della Rondinella 18/7, Genoa, Italy

[21] Appl. No.: 202,292

[22] Filed: Oct. 30, 1980

[30] Foreign Application Priority Data

Nov. 12, 1979 [IT] Italy ..... 12814 A/79

[51] Int. Cl.[3] ..... B66C 23/06

[52] U.S. Cl. ..... 212/199

[58] Field of Search ..... 212/199–203

[56] References Cited

U.S. PATENT DOCUMENTS 3,365,077 1/1968 Mork ..... 212/199 X 4,240,558 12/1980 Mustonen ..... 212/200 X

*Primary Examiner*—Robert G. Sheridan

*Attorney, Agent, or Firm*—Robert E. Burns; Emmanuel J. Lobato; Bruce L. Adams

[57] ABSTRACT

The object of the present invention consists in a tower traveling crane which, being endowed with a special jib movement system is characterized in that—differently from other types of similar cranes—its vertical dimensions can be kept to a minimum, though operating with the amplest jib range of movements and overcoming frontal obstacles of remarkable height.

4 Claims, 2 Drawing Figures

JIB CRANE WITH POLYCENTRICAL TRAJECTORY

BACKGROUND OF THE INVENTION

The two conventional types of traveling cranes, which differ substantially from one another depending on whether the arm is pivoted on the crane bed or on a proper tower-shaped vertical upright, having the following operational limitations:

With the first, it is possible to operate at the maximum straddle only on spaces which are free near the crane. Indeed, the presence of bulky obstacles would hinder the free opertion of the jib which, when at a minimum slant, is comparatively low.

In the second type, the jib articulation placed at a certain height permits the crane to easily operate with front obstacles in the working area, but it has the disadvantage of leading to a remarkable increase in the total height of the crane when handling loads placed near it. Indeed, in these work conditions, the total height tends to reach a value equal to the height of the jib plus the height of its articulation joint.

OBJECTS OF THE INVENTION

The purpose of the invention is therefore to obtain a jib crane having the advantage of operating also in the presence of obstacles of considerable size, maintaiing a total height approximately equal to the jib length.

This has been obtained, according to the invention, by substituting to the fixed jib articulation support a vertically movable trolley, on which the jib articulated support is now housed.

In other words, according to the invention, there has been introduced—between the two elements consisting in the jib and the upright—a third element consisting in a vertically movable trolley, on which the articulated support of the jib is housed.

By this invention, it is now possible to maintain a limited vertical dimension of the crane, considering that when work is done with the utmost straddle the jib articulation joint reaches the highest position, whereas in the minimum straddle conditions the articulations joint reaches the lowest position.

Moreover, according to the invention, suitable devices are provided, permitting to automatically control the jib inclination just be vertically moving the trolley from its articulation joint along the upright.

It is moreover interesting to note that, according to the invention, the trajectory of the jib end is a very flat polycentrical curve, having a flow similar to that of a horizontal parabola, whereas in conventional traveling cranes said trajectory consist in an arc of circle, with the centre in the fixed jib articulation joint.

DESCRIPTION OF A PREFERRED EMBODIMENTS

With reference to said figures, 10 shows a crane truck provided with a base 11 on which there is mounted a substantially vertical tower 12.

In a known way, said tower is provided with a lower articulation 13 which permits to slant it forward in order to reduce—when needed—the crane's dimensions in height during traverse.

Figure 1:
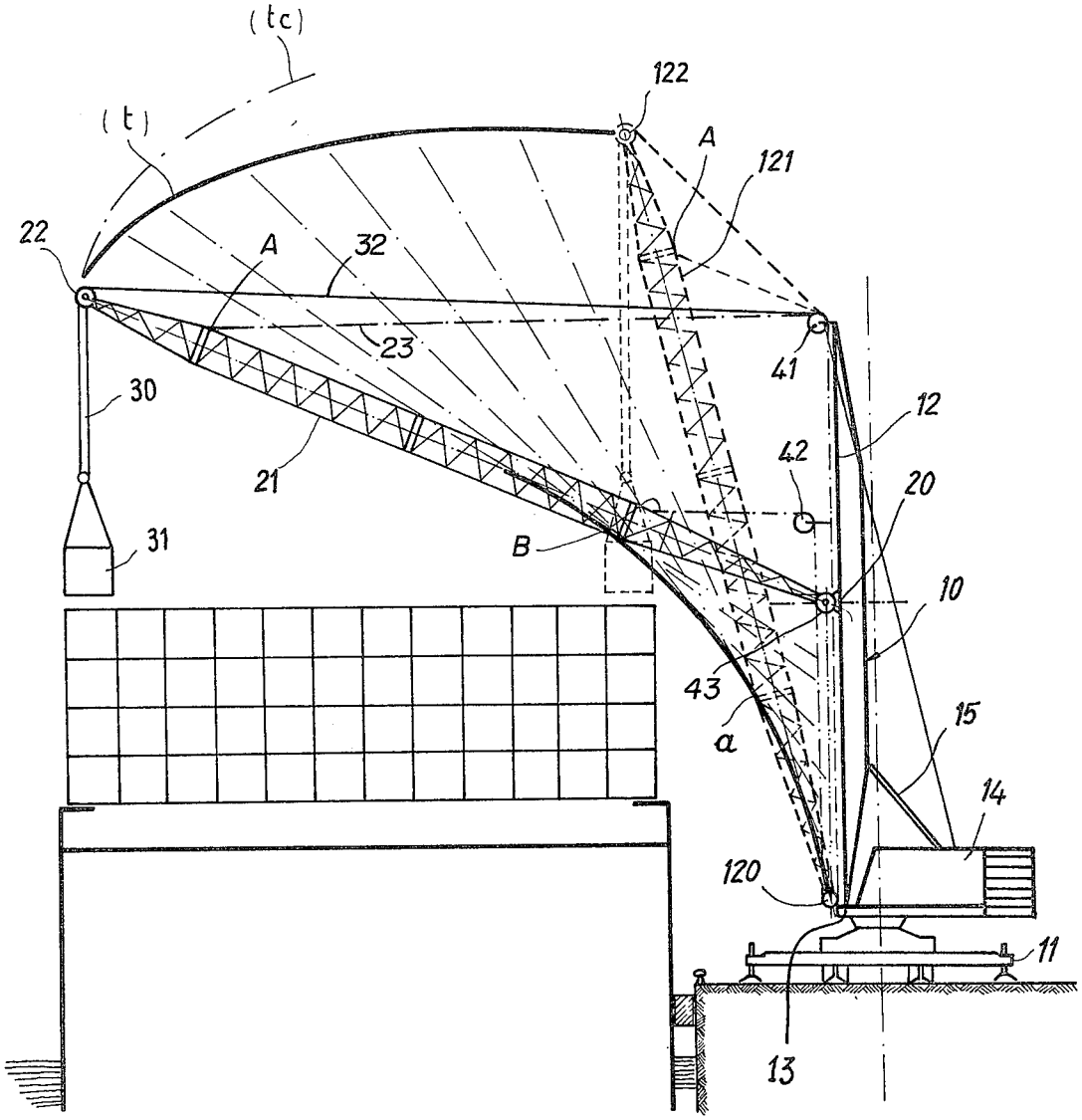
FIG. 1 shows the outline of a crane according to the invention, in different positions of the relevant jib.

In operating position, said tower 12 is, as shown in FIG. 1, in a substantially vertical position.

Moreover, again in a way per se known lower articulation joint 13 of tower 12 is mounted on base 11 through a rotating platform 14 on which the control elements are assembled. Suitable tie rods 15 maintain tower 12 in its vertical operating position.

Along tower 12 there is slidable trolley 20 on which is pivoted, on the vertical plane, crane jib 21.

A hoist 30 for suspended load 31 is operated, in a way per se known, by means of a lifting cable 32, and one end of the hoist cable is fastened to outer end 22 of jib 21.

According to the invention, the two movements of jib 21 are the first movement consist in the traverse of trolley 20 along tower 12; the second movement of jib 21 consist in the rotation about its lower fulcrum 20 by means of lift 23.

It is evident that the vertical traverse of trolley 20 must go together with the rotation of the jib about its fulcrum.

It appears from the above that the trajectory of outer end 22 of jib 21 is no longer defined by a single arc a circle equal to the jib length, and having a fixed centre in correspondence with the jib articulation joint, as in conventional tower cranes: indeed, according to the invention, the jib articulation point 20, moves vertically when the jib slant changes, i.e. when the distance between the anchorage point (A) of the lift 23 and the pulley 41 changes. As a matter of fact, the distance between point (A) and pulley 41 decreases when trolley 20 goes down, respectively increases when trolley 20 rises. Consequently, the possible trajectories of the crane jib outer end consist in a plurality of arcs of a circle, having a constant radius, the centre of which is movable together with trolley 20.

In FIG. 1, 122 and 22 show the extreme positions, respectively upper and lower, of the free end of jib 21. The position of the crane jib associated to point 122 of trajectory (t) is shown by a dotted line and by reference number 121.

It is interesting to note that polycentrical curve (t) is well below curve (te) which would be described by the outer end of the crane if its articulation joint to tower 12 were fixed, as in conventional tower cranes. By associating a lowering, respectively a rising, of trolley 20 to an angular upwards traverse, respectively downwards, of the crane jib, the greatest advantages can be drawn from the crane according to the invention. Indeed, in the lowest position of the trolley, when the crane straddle is at a minimum, the crane dimension in height is reduced to the length of the crane jib, clean from the height of tower 12, length of which is instead added to the length of conventional tower jibs when defining the latter's dimensions in height.

In the raised position of trolley 20, when the straddle is at a minimum, the jib crane according to the invention behaves like a conventional crane, thus allowing for cargo handling even in the presence of front obstacles of remarkable height, diagramatically shown in the figure in the form of stacked-up containers on the deck of a ship moored on the dock under the crane.

It must be noted that during the passage of the crane jib from end position 21 to end position 121, when, as preferred, the jib slant is associated to the traverse of trolley 20, the crane jib axis describes, by envelopement, a curve, shown as (a) in FIG. 1 defining the dimension in height of the front obstacles in the presence of which the crane can still work.

As said above, according to a preferred embodiment of the invention, the jib slant movement and the vertical traverse movement of trolley 20 are associated so as to simultaneously allow for the use of the crane maximum straddle in the presence of maximum dimensions in height of possible front obstacles (position 21–22) and the use of crane minimum straddle (position 122–121) with a minimum dimension in height of the jib; between said two end positions, the dot and line segments defining the above mentioned curve (a) represent the intermediate positions of the crane jib.

According to a further preferred embodiment the jib slant movements and the vertical traverse of trolley 20 are so associated as to be controlled, through a single control element, whever it is desired that the trajectory of the free end of the crane jib be the one represented by the polycentrical curve (t).

To this purpose, according to the invention, there is a passive lift at the ends, in two suitably chosen intermediate points A and B of the jib.

Said passive lift is transmitted by three pulleys 41, 42 and 43 of which the first is placed in correspondence with the upper end of tower 12, the second at a point, for example intermediate, between the upper end of tower 12 and the highest position of trolley 20, and the third in correspondence with the trolley 20 itself.

Thus, the angular movement of the crane jib is indirectly controlled by the vertical movement of trolley 20.

Let us suppose, in fact, in a first position, the crane jib is in position 21, and the trolley on which the jib is hinged is in position 20.

Figure 2:
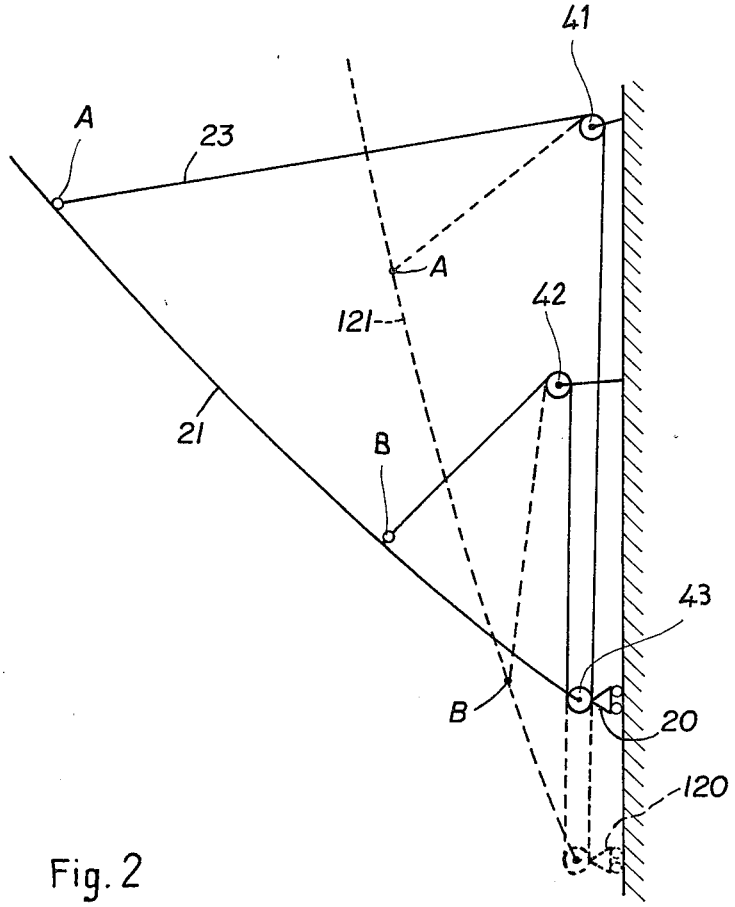
FIG. 2 shows in detail the passive lift used in a preferred embodiment of the invention.

By lowering trolley 20 down to position 120, the length of passive lift track included between points 42 and 43 of FIG. 2 becomes obviously elongated twice the tract run by the trolley, whereas the lift tracks included between points A and 41 and points B and 42 shorten by a different length. Consequently, the shape of the two curves (t) and — (a) can be varied between comparatively wide limits, by suitably choosing the length of the passive lift, as well as the position of anchoring points A and B of gear transmission 41 and 42. Besides, the movement of the crane jib in the vertical plane exclusively depends on the actuating means of trolley 20-which reduces the number of strictly indispensable driving means to one only.

What I claim is:

1. A tower crane comprising a vertical tower, a trolley movable vertically on said tower, a jib pivotally connected to said trolley and extending at an angle from said vertical tower, a pulley at an outer end of said jib, a hoist running over said pulley and down to a suspended load and means for varying the angle of said jib as a function of the vertical position of said trolley to decrease the angle between said jib and said tower when said trolley descends and conversely to increase the angle between said jib and said tower as said trolley ascends.

2. A tower crane according to claim 1, in which said means for varying the angle of said jib comprises a cable which has one end attached to an outer portion of said jib, passes over a first pulley mounted on an upper portion of said tower down around a second pulley mounted on said trolley, then up over a third pulley mounted on an intermediate portion of said tower and has an opposite end attached to an intermediate portion of said jib.

3. A tower crane according to claim 2, comprising means for varying the length of said cable so as to vary the trajectory defined by the outer end of said jib up on vertical movement of said trolley.

4. A tower crane according to claim 2 or 3, comprising means for varying the positions of said first and third pulleys on said tower to vary the trajectory defined by the outer end of said jib upon vertical movement of said trolley.

* * * * *